US005852348A

United States Patent [19]

Lin

[11] Patent Number: 5,852,348

[45] Date of Patent: Dec. 22, 1998

[54] CHRISTMAS TREE ORNAMENTAL LIGHTING SYSTEM

[76] Inventor: Wen-Juei Lin, No. 347, Yuh-Her St., Shin-Diann City, Taipei, Taiwan

[21] Appl. No.: 852,420

[22] Filed: May 8, 1997

[51] Int. Cl.[6] ..... H05B 37/00

[52] U.S. Cl. ..... 315/185 R; 315/185 S; 362/806

[58] Field of Search ..... 315/185 R, 185 S, 315/201, 130, 323, 200 A, 161, 210; 362/123, 800, 806

[56] References Cited

U.S. PATENT DOCUMENTS

| | | | |
|---|---|---|---|
| 4,769,579 | 9/1988 | Jou | 315/201 |
| 5,317,238 | 5/1994 | Schaedel | 315/323 |
| 5,495,147 | 2/1996 | Lanzisera | 315/185 |
| 5,632,550 | 5/1997 | Yeh | 362/123 |

*Primary Examiner*—Don Wong
*Assistant Examiner*—David H. Vu
*Attorney, Agent, or Firm*—Rosenberg, Klein & Bilker

[57] ABSTRACT

A Christmas tree ornamental lighting system is provided having a light strand combining primary lights and secondary lights, which illuminate in unison. A first illuminating component, represents a prearranged decorative pattern object and is coupled to a primary light and is illuminated, when the primary light is in a not illuminated state, and does not illuminate, when the primary light illuminates. A temperature switching function of the primary light is used to switch between the illuminate and non-illuminate states. A second illumination component, which also represents a prearranged pattern, is coupled to a secondary light and illuminates in synchronism with a respective secondary light. The lighting system achieves an enriched visual effect by taking advantage of the illuminate and non-illuminate states of the primary and secondary lights and first and second illuminating components, and various transitions between them.

13 Claims, 5 Drawing Sheets

CHRISTMAS TREE ORNAMENTAL LIGHTING SYSTEM

BACKGROUND OF THE INVENTION

Animated decorations that present an attractive evening display are generally available today in the form of Christmas lights or other light bulbs and lighting tubes which are utilized to produce various images. Of these, Christmas lights having flashing effects are perhaps the most common. However, as is well known, flashing Christmas lights typically include several groups of primary lights and other light bulbs (secondary lights) constituting a string of lights, such that when the Christmas light strand is powered, the bulbs of the primary lights instantly illuminate and the temperature of the primary lights begins to rise. When the temperature reaches a set value, the primary lights are switched off, thereby extinguishing the illumination of the primary lights, which then causes the extinguishing of the remaining secondary lights. Furthermore, when the primary lights are not illuminated, the temperature of the primary lights decreases and when the temperature returns to a certain set value, the illumination operation is restored, with the secondary lights in the same group also resuming illumination. Undeniably, this type of directly utilized flashing illumination of Christmas light strands creates a bright and attractive visual effect to people.

The conventional animated Christmas decorations available now, and even the seasonal holiday decorations, utilize the most ordinary of methods, and the flashing effects of Christmas light strands mainly consist of light bulbs that are directly triggered in intermittent pattern of illumination and non-illumination. Although having certain attractiveness, the mere operation of bringing light bulbs into illumination and non-illumination state, thereby opposing the extreme brightness during illumination to the extreme darkness during non-illumination, was not impressive enough.

SUMMARY OF THE INVENTION

As can be realized by the foregoing discussion, the structures of the conventional Christmas light decorations, in terms of actual application and utilization, were obviously replete with shortcomings that needed improvement.

Therefore, the major object of the present invention is to provide a Christmas tree ornamental lighting system, wherein cold light panels of arrays of light-emitting diodes (LEDs) are utilized as the illumination components that can be directly formed or prearranged into various ornaments, words and pictures, or patterned into images.

It is another object of the present invention to provide a Christmas tree ornamental lighting system, wherein the illumination component units of two types are integrated to the primary lights (first type illumination component unit) and the secondary lights (second type illumination component unit) of Christmas light strands, wherein, when the primary lights are "not illuminated," the secondary lights can be triggered into the "illuminated" state to produce light of the lower intensity, thereby diversify visual effect generated by the lighting system, and wherein the first type illumination component unit illuminates when the primary light in its "non-illuminate" state and the second type illumination component unit illuminates in unison with the secondary light.

It is still another object of the present invention to provide a Christmas tree ornamental lighting system, wherein the first type illumination component units take advantage of the temperature switching function of the primary lights, and the second type illumination component units include a resistance having a value that is equivalent to the resistance of the secondary lights on the Christmas light strands.

According to the teachings of the present invention, a Christmas tree ornamental lighting system includes a light strand which has primary lights and secondary lights associated with said primary lights. The primary lights and secondary lights illuminate in synchronism, as well as do not illuminate in substantial synchronism.

Each primary light includes a primary light bulb and a primary light socket at the light strand; as well as each secondary light includes a secondary light bulb and a secondary light socket at the light strand.

It is an essential feature of the present invention, that the Christmas tree ornamental lighting system includes a first illumination component unit and a second illumination component unit. The first illumination component unit is coupled to a primary light, so that when the primary light illuminates, the first illumination component unit does not illuminate. The second illumination component unit, being coupled to the secondary light, illuminates in synchronism with the secondary light, and does not illuminate in synchronism with the non-illuminate state of the secondary light.

The first illumination component unit comprises a first illumination component (which may be a cold light panel or a plurality of LEDs prearranged in an array thereof), a primary light socket at the first illumination component unit, and a first socket coupled to the primary light socket at the light strand. Preferably, the primary light bulb is coupled to the primary light socket at the first illumination component unit.

When the first illumination component is a cold light panel, the first illumination component unit further comprises a voltage amplifier and frequency converter circuit coupled to the input of the first illumination component, and a voltage dropper and a regulator circuit coupled to the input for the first voltage amplifier and frequency converter circuit. When the first illumination component is a plurality of LEDs, the first illumination component unit includes a current limiting resistor coupled between the primary light socket at the first illumination component unit and the first illumination component.

Preferably, the plurality of LEDs includes at least one leg comprising a group of first LEDs connected in series and in like orientation thereof, and a second LED connected in series with and inversely to the first LEDs. At least two said legs may be connected in parallel, with the LEDs in one leg being in inverse orientation with respect to the LEDs in adjacent leg.

The second illumination component unit comprises a second illumination component, a resistor coupled to the input of the second illumination component, and a second socket coupled to said secondary light socket at said light strand. When the second illumination component is a cold light panel, the second illumination component unit further includes a voltage amplifier and frequency converter circuit coupled to an input of the second illumination component, and a second voltage dropper and regulator circuit coupled to the input of the voltage amplifier and frequency converter circuit. Also, this resistor is a shunt resistor, coupled to the input of the voltage dropper and regulator circuit and providing for matching between the overall resistance of the second illumination component unit and a resistance of the secondary light.

Preferably, when the second illumination component includes a plurality of LEDs, they are arranged in a plurality of parallely connected legs, each of which includes a pair of similarly oriented serially connected diodes, with the orientation of diodes in adjacent legs being inverse.

These and other novel features and advantages of the invention will be fully understood from the following detailed description and the accompanying drawings.

DETAILED DESCRIPTION OF THE PREFERRED EMBODIMENT

Figure 1:
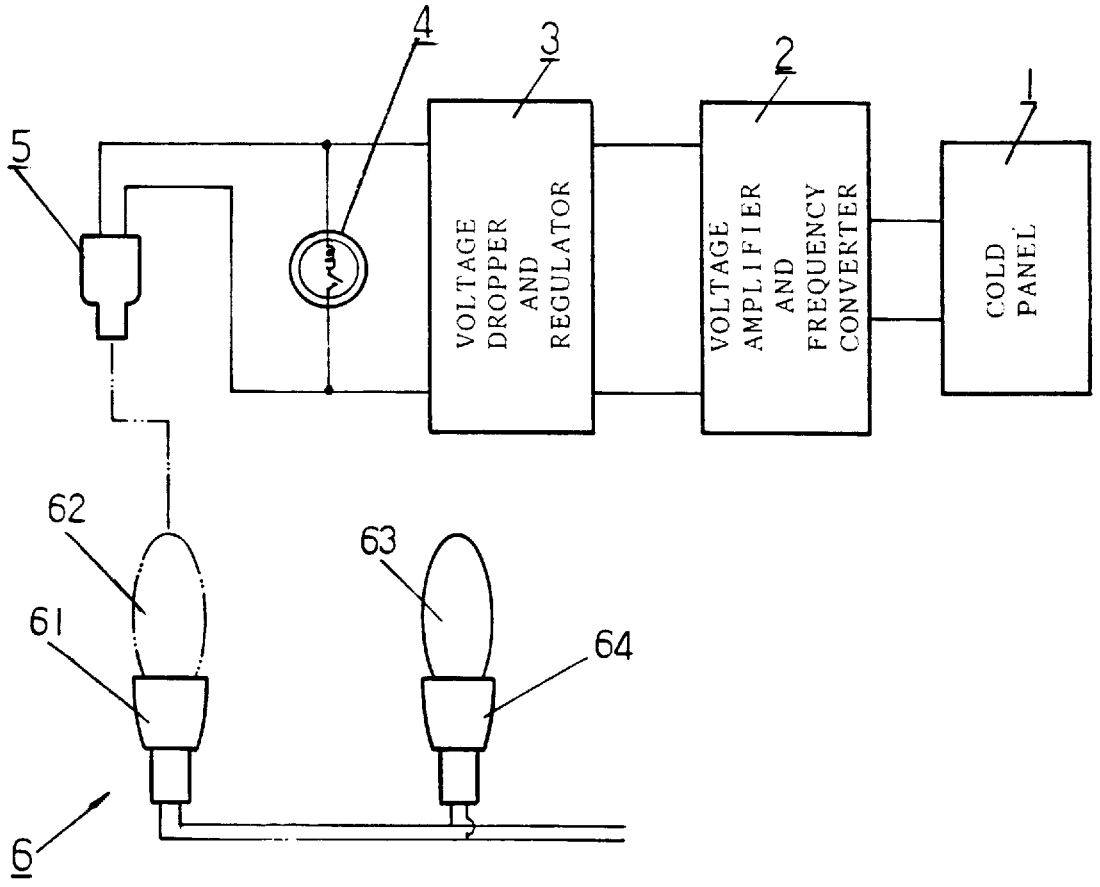
FIG. 1 is a block diagram of the present invention showing first type illumination component unit with the cold light panel integrated to the primary light.

Referring to FIG. 1, the Christmas tree ornamental lighting system includes illumination components constituting prearranged pictures, words or patterns. A cold light panel or array of light-emitting diodes (LEDs) presenting these prearranged patterns and driving circuitry constitute illumination component units that are directly integrated to conventional Christmas light strands which enables Christmas light decorations to be more spectacular, to have richer variation, better attractiveness and a more animated appearance in the darkness. The main methods of integrating the illumination components (including the respective driver circuits) to the Christmas lighting strands (6) consists of two approaches: integration to the primary lights (62) and integration to the secondary lights (63). The integration of the illumination components (including the respective driver circuits) to the primary lights assumes utilization of the temperature switching effect of the primary lights (62). When the primary light (62) is in the "illuminated" state, the voltage at the two terminals thereof is extremely low (approximately 6 VAC or 12 VAC) and this low current is incapable of driving the associated illumination component. However, when the temperature rises to a predetermined value and the internal switch of the primary light automatically becomes an "open circuit," thereby rapidly switching the primary light (62) to the "non-illuminated" state, the voltage at the two terminals thereof is nearly equal to the higher magnitude of the input voltage (110 VAC or 220 VAC), which is supplied to the illumination component such that the illumination component is driven to emit light presenting a predetermined decorating pattern. The integration of the illumination components with the secondary light (63) mainly consists of utilization of the Christmas light strand in the "illuminated" state, such that when the current flow is established, illumination components associated with the secondary light, emit light due to the resistance of the secondary light being equal to the resistance of the driver circuit of the illumination components. The illumination components, therefore, "illuminate" and "do not illuminate" in a synchronism with each secondary light bulb of the Christmas light strand.

Referring to FIG. 1, a first type illumination component unit is shown, in which a cold light panel (1) is the part of the illumination component unit integrated to the primary light (62) of the Christmas light strand (6). In the illumination component unit, the cold light panel (1) is coupled to a voltage amplifier and frequency converter circuit (2), a voltage dropper and regulator circuit (3), a primary light socket (4) at the illumination component unit and a socket (5). The bulb of the primary light (62) is directly coupled at the primary light socket (4) position at the illumination component unit, with the socket (5) directly connected to the primary light socket (61) position at the Christmas light strand (6). The primary light (62) utilized for the Christmas tree ornamental lighting system of the present invention, essentially serves as a temperature switch (as discussed above). When the cold light panel (1) is subjected to the appropriate voltage (more than 100V), frequency (approximately 460 to 800 Hz), and thereby driven, an extremely low intensity illumination is automatically produced as a characteristic, and then when the Christmas light strand (6) is connected to current and the secondary lights (63) associated with the primary lights (62) "illuminate," the voltage established at the two terminals through the primary lights (62) is very low (6V or 12V) and insufficient to drive the cold light panel (1) into illumination state. Conversely, when the primary lights (62) are open circuited and the secondary lights (63) are in a state of "no illumination," then voltage at the two terminals is nearly equal to the higher magnitude of the input voltage. Being supplied to the illumination component unit, higher voltage drives the cold light panel (1) (including the driver circuit) into illumination state.

Figure 2:
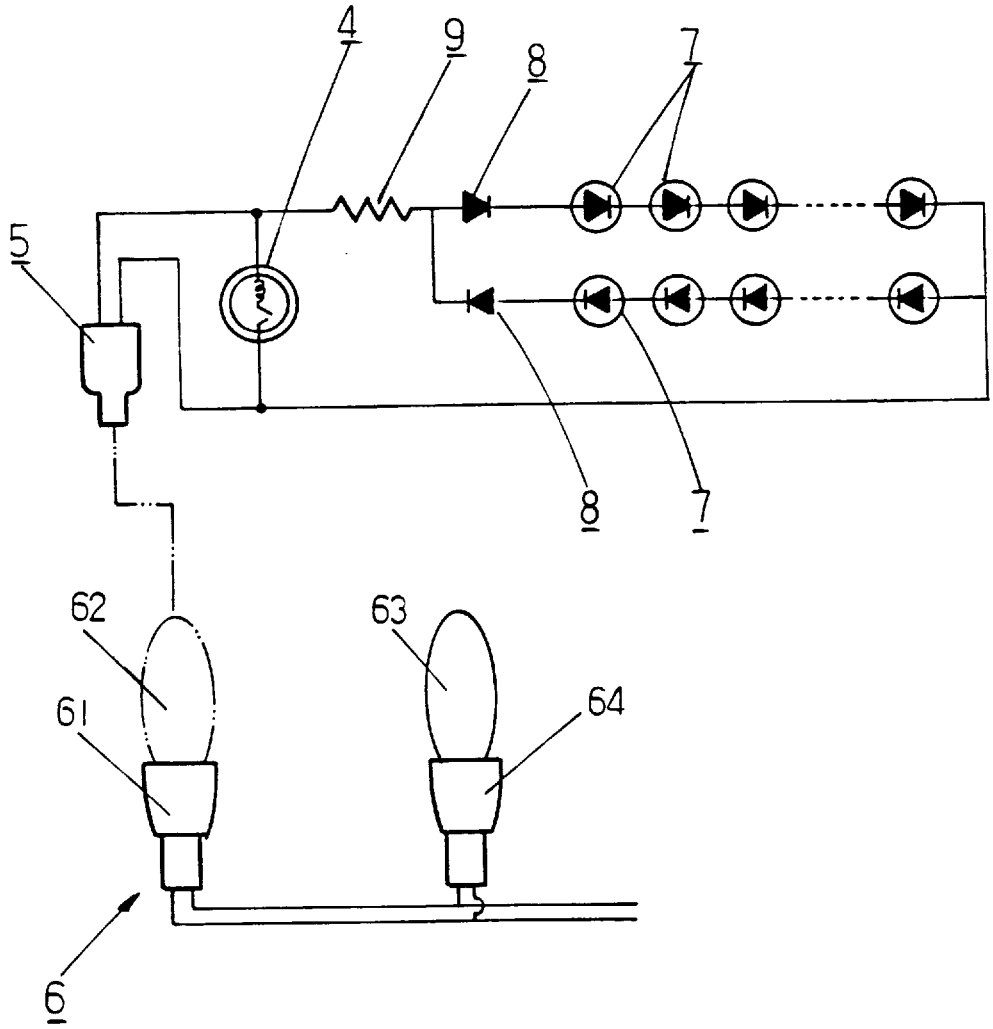
FIG. 2 is a schematic diagram of one embodiment of the present invention showing first type illumination component unit with the LED array integrated to the primary light.

Referring to FIG. 2, the first type illumination component unit includes LEDs to be integrated with the primary light (62) of the Christmas light strand (6). The LEDs array consists of two groups having a predetermined number of LEDs (7) distributed to support one LED (8), interconnected first in a series orientation in each leg (both legs being connected in parallel), and then coupled to the resistor (9), the primary light socket (4), and the socket (5). The method of coupling the elements in FIG. 2 to the Christmas light strand (6) is identical to that of the cold light panel illumination component installation method shown in FIG. 1, and consists of placing the bulb of the primary light (62) in the primary light socket (4) position of the LED illumination component unit, and connecting the socket (5) of the LED unit directly to the primary light socket (61) of the Christmas light strand (6) causing, when the primary light (62) is "illuminated," that the aforesaid in-series LEDs do not emit light, and when the primary light (62) is "not illuminated," the in-series LEDs can flash into "illumination." The selection of the resistor (9) value is determined by the voltage consumed when the in-series LEDs are driven into "illumination," which mainly consists of the voltage enabling the in-series LEDs at the current resistor (9) to limit the current and lower the voltage, such that when the primary light (62) is "illuminated," the LEDs cannot be driven into illumination, and when the primary light (62) is in the "non-illuminated" state, and until the primary light (62) is driven into illumination, then the primary light (62) prevents surge damage and effectively stops burnout. The installation of the two diodes (8) is determined by the LEDs (7) and work as a half-wave bridge preventing breakdown due to excessive voltage application. Since the diodes (8) are connected in series with the LEDs (7), a direct saving of electricity is achieved.

Figure 3:
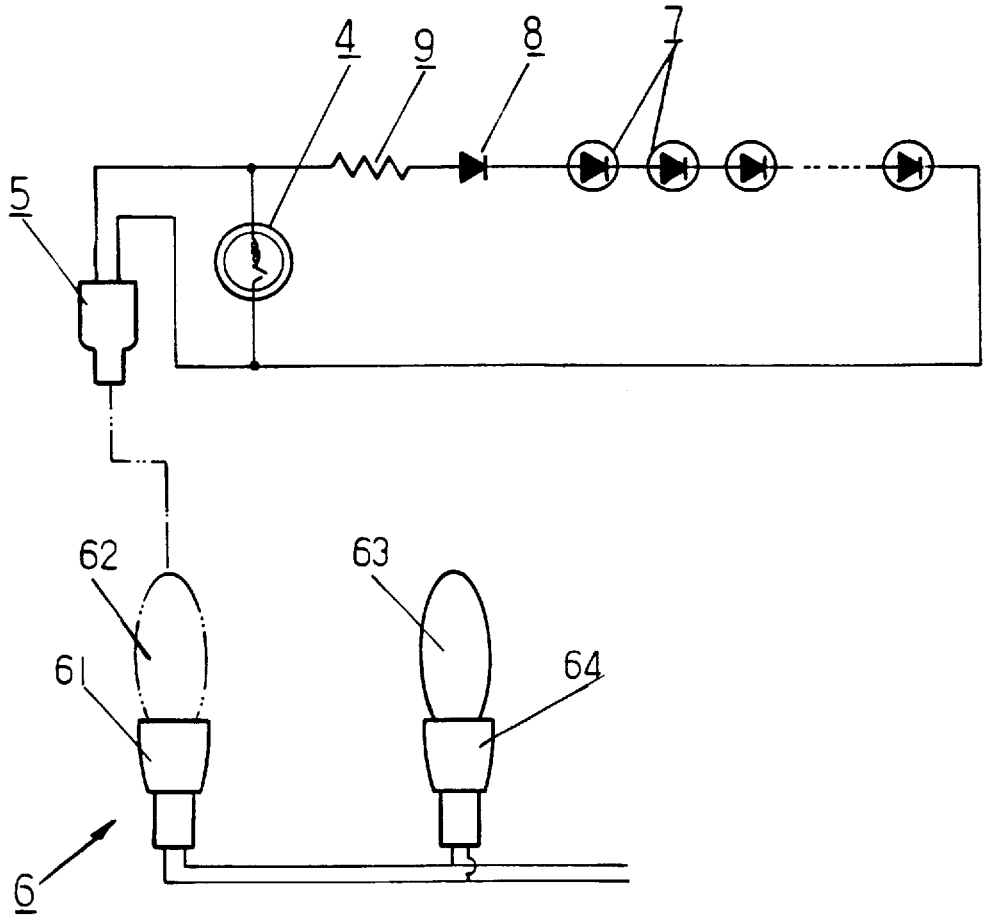
FIG. 3 is a schematic diagram of another embodiment of the present invention showing first type illumination component unit with the LEDs integrated to the primary light.

Referring to FIG. 3, when the number of LEDs is smaller than the surface area of the picture or words and the illumination component includes a diffuser to enable the production of a picture or words formed by illumination components integrated to the primary light of the Christmas light strand, then the aforesaid LEDs (7) and diodes (8), and the resistor (9) can be directly connected in series (through the half-wave bridge), thereby enabling the diffuser and the aforesaid smaller number of LEDs (7), as shown in FIG. 3, to display the picture or words.

Figure 4:
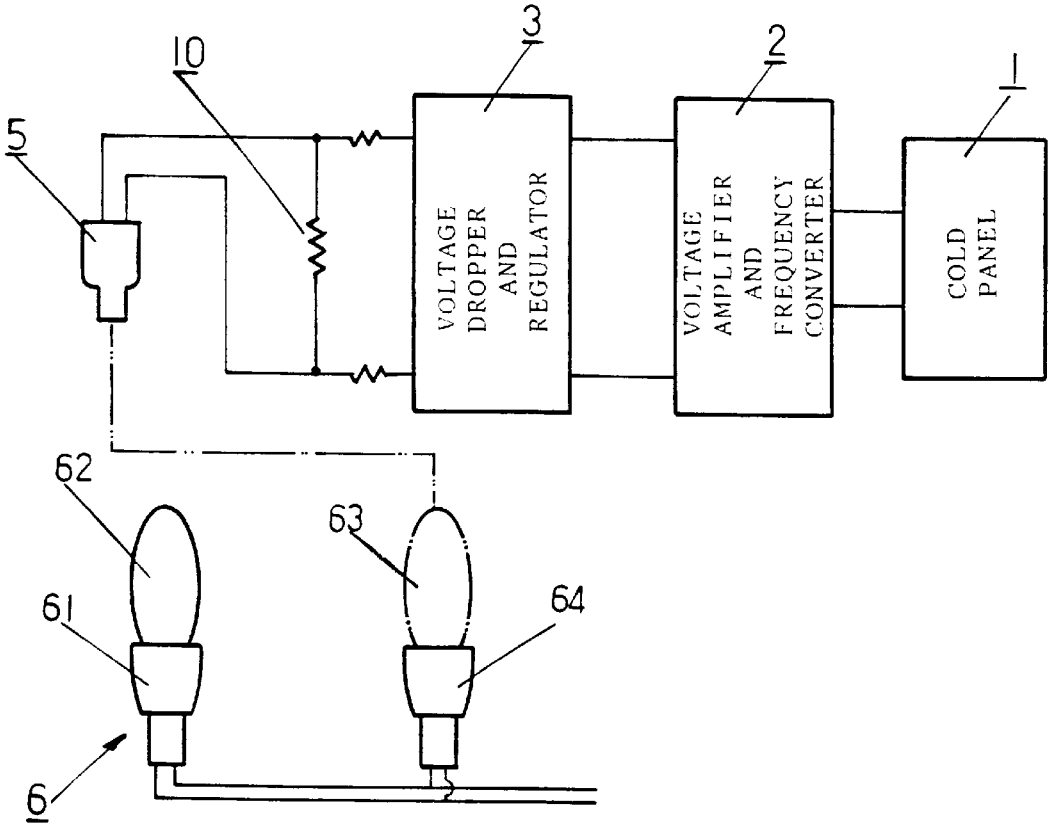
FIG. 4 is a block diagram of the present invention showing second type illumination component unit with the cold light panel integrated to the secondary light.

Referring to FIG. 4, showing the second type illumination component unit, in which the cold light panels are the desired illumination components to be integrated to the secondary light (63) of the Christmas light strand (6), the cold light panel (1) is first connected to the voltage amplifier and frequency converter circuit (2), the voltage regulator circuit (3), the shunt resistor (10) and the socket (5), thereby constituting an illumination component unit, which is connected to any secondary light (63) on the light strand (6), by coupling the socket (5) to the secondary light socket (64) at the light strand. The shunt circuit resistor (10) of the embodiment shown in FIG. 4, reduces the overall resistance of the illumination component unit and, thereby, enables the overall resistance to become equal to the resistance of the secondary light (63) on the Christmas light strand (6), i.e., the current flowing through the illumination component unit of FIG. 4 is the same as the current flowing through the secondary light (63). Thus, when the Christmas light strand (6) is in the "illuminated" state, the current flowing through Christmas light strand (6) is fixed, and after the second type illumination component unit is assembled to a secondary light socket (64), the current flowing through the secondary light socket (64) and the secondary light (63) is identical and, therefore, the illumination component unit operates with each light of the Christmas light strand (6) synchronously flashing between the "illuminated" and "non-illuminated" states. Since the cold light panel (1) illumination components require a relatively higher frequency voltage to be driven into illumination, the illumination component unit only requires the supportive operation of the voltage regulator circuit (3) along with the voltage amplifier and frequency converter circuit (2) to achieve illumination.

Figure 5:
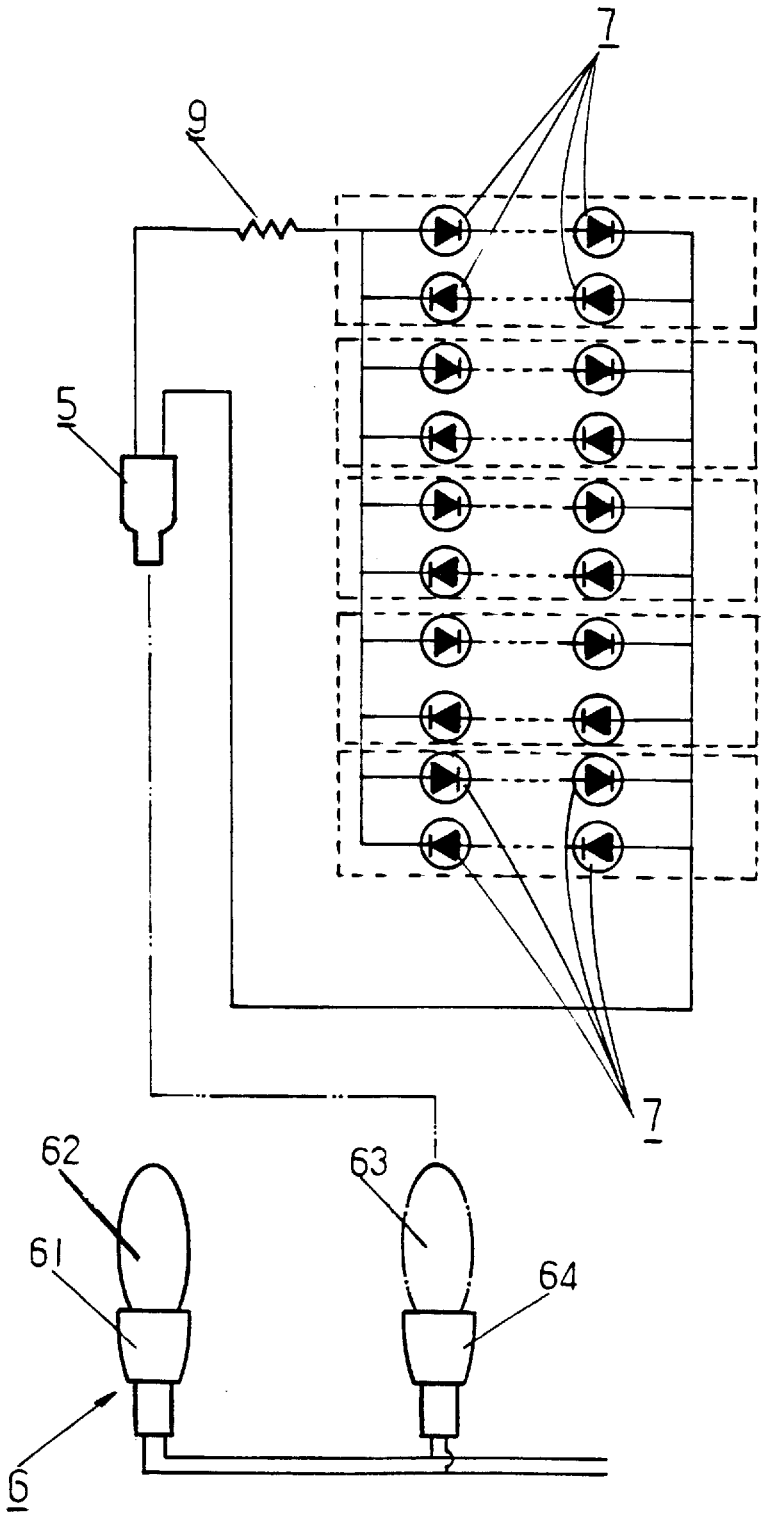
FIG. 5 is a schematic diagram of the present invention showing second type illumination component unit with the LED array integrated to the secondary light.

Referring to FIG. 5, when the LEDs (7) of the second type illumination component unit are the desired illumination components to be integrated to the secondary light (63) of the Christmas light strand (6), then LEDs (7) are first formed into a number of small groups and then two small groups are formed into a number of larger groups, and then connected to the resistor (9) and socket (5). As shown in FIG. 5, two small groups of the larger group of LEDs (7) are interconnected in series, with LEDs in adjacent groups being arranged in inverse orientation with respect to each other.

Selecting any secondary light (63), similar to that previously described, the socket (5) of the circuit is directly connected to the secondary light socket (64) at the strand. The two small groups of LEDs (7) in the aforesaid large groups are first interconnected in series in the same orientation in the same leg and then inversely in adjacent legs, thereby constituting a half-wave bridge, and thereby directly supplying alternating current through. The total current consumed by the illumination components is equal to the electricity consumed by the predetermined number of secondary lights (63), therefore, after the socket (5) of the illumination component unit is connected to the secondary light socket (64) at the strand (6), the current limiting resistor (9) limits the current in support, and the illumination components of the aforesaid LED array are enabled, with the primary light (62) of the Christmas light strand (6) and the secondary light (63) driven into operation by flashing synchronously between being "illuminated" and "non-illuminated." The current flow through the illumination component unit is the same as that of the secondary light (63) and, therefore, the illumination components (as pictures or words, etc.) of the illumination component unit can be installed on any secondary light socket (64) of the Christmas light strand (6), thereby enabling the Christmas light strand to display a variety of animated and attractive shapes.

It is readily appreciated by those skilled in the art, that the configuration of the present invention is simple and does not require subjecting a typical Christmas light strand to substantial design changes, except when the socket (5) of the present invention is connected to the primary light socket (61) or any secondary light socket (64) of the typical Christmas light strand (6), that results is a genuine Christmas tree light decoration that is animated, beautiful and rich in variation for additional night viewing attractiveness.

What is claimed is:

1. A Christmas tree ornamental lighting system, comprising:

a light strand, including:

at least one primary light, and at least one secondary light associated with said at least one primary light, said at least one primary light and said at least one secondary light having substantially synchronous illuminate states thereof and substantially synchronous non-illuminate states thereof, said at least one primary light including a primary light bulb and a primary light socket on said light strand, said at least one secondary light including a secondary light bulb and a secondary light socket on said light strand; and at least one first illumination component unit coupled to said at least one primary light, said at least one first illumination component unit being in an illuminate state thereof substantially in synchronism with said non-illuminate state of said at least one primary light, and further being in said non-illuminate state thereof substantially in synchronism with said illuminate state of said at least one primary light;

said at least one first illumination component unit comprising:

(a) a first illumination component, (b) said primary light socket on said at least one first illumination component unit coupled in parallel to an input of said first illumination component, said primary light bulb being coupled to said primary light socket on said at least one first illumination component unit, and (c) a first socket coupled to said primary light socket on said light strand.

2. The Christmas tree ornamental lighting system of claim 1, further including at least one second illumination component unit coupled to said at least one secondary light, said at least one second illumination component unit being in said illuminate state thereof substantially in synchronism with said illuminate state of said at least one secondary light, and further being in said non-illuminate state thereof substantially in synchronism with said non-illuminate state of said at least one secondary light;

said at least one second illumination component unit comprising:

(a) a second illumination component, (b) a resistor coupled to an input of said second illumination component, and (c) a second socket coupled to said secondary light socket on said light strand.

3. The Christmas tree ornamental lighting system of claim 2, wherein said second illumination component includes a cold light panel.

4. The Christmas tree ornamental lighting system of claim 3, further including:

a first voltage amplifier and frequency converter circuit coupled to an input of said second illumination component, and a first voltage dropper and regulator circuit coupled to an input of said first voltage amplifier and frequency converter circuit, wherein said resistor includes a shunt resistor coupled to an input of said first voltage dropper and regulator circuit, said shunt resistor providing for matching between an input resistance of said at least one second illumination component unit and a resistance of said at least one secondary light.

5. The Christmas tree ornamental lighting system of claim 2, wherein said second illumination component includes a plurality of LEDs, further including a current limiting resistor coupled between said second socket and said second illumination component.

6. The Christmas tree ornamental lighting system of claim 5, wherein said plurality of LEDs includes a plurality of parallel legs, each leg including at least a pair of LEDs connected in-series and in the same orientation thereof, said LEDs in adjacent said legs having inverse orientation thereof.

7. The Christmas tree ornamental lighting system of claim 1, wherein said primary light bulb of said at least one primary light includes a switch for switching said at least one first illumination component unit between said illuminate and non-illuminate states thereof at a predetermined temperature.

8. The Christmas tree ornamental lighting system of claim 1, wherein said first illumination component includes a cold light panel.

9. The Christmas tree ornamental lighting system of claim 8, further including:

a first voltage amplifier and frequency converter circuit coupled to an input of said first illumination component, and a first voltage dropper and regulator circuit coupled to an input of said first voltage amplifier and frequency converter circuit.

10. The Christmas tree ornamental lighting system of claim 1, wherein said first illumination component includes a first plurality of LEDs.

11. The Christmas tree ornamental lighting system of claim 10, further including a current limiting resistor coupled between said primary light socket at said at least one first illumination component unit and said first illumination component.

12. The Christmas tree ornamental lighting system of claim 10, wherein said first plurality of LEDs includes at least one leg comprising a group of in-series connected first LEDs having similar orientation thereof, and a second LED connected in-series with and inversely to said first LEDs.

13. The Christmas tree ornamental lighting system of claim 12, further including at least two said legs connected in parallel, said first LEDs in one of said at least two said legs being connected in inverse orientation to first LEDs in another one of said at least two said legs.

* * * * *